US009399550B2

(12) United States Patent
Haimoff

(10) Patent No.: US 9,399,550 B2
(45) Date of Patent: Jul. 26, 2016

(54) PEDAL-BIN ASSEMBLY

(75) Inventor: Efraim Haimoff, Mevaseret Zion (IL)

(73) Assignee: KETER PLASTIC LTD., Herzel Yia (IL)

( * ) Notice: Subject to any disclaimer, the term of this patent is extended or adjusted under 35 U.S.C. 154(b) by 0 days.

(21) Appl. No.: 13/578,322

(22) PCT Filed: Feb. 15, 2011

(86) PCT No.: PCT/IL2011/000160

§ 371 (c)(1),
(2), (4) Date: Aug. 10, 2012

(87) PCT Pub. No.: WO2011/099017

PCT Pub. Date: Aug. 18, 2011

(65) Prior Publication Data

US 2012/0305561 A1 Dec. 6, 2012

Related U.S. Application Data

(60) Provisional application No. 61/304,607, filed on Feb. 15, 2010.

(51) Int. Cl.

| | |
|---|---|
| ***B65D 43/26*** | (2006.01) |
| ***B65F 1/14*** | (2006.01) |
| *B65F 1/06* | (2006.01) |
| *B65F 1/16* | (2006.01) |

(52) U.S. Cl.

CPC ..... *B65F 1/163* (2013.01); *B65F 1/1421* (2013.01); *B65F 1/1646* (2013.01); *B65F 1/06* (2013.01); *B65F 2001/1661* (2013.01); *B65F 2001/1669* (2013.01)

(58) Field of Classification Search

CPC ..... B65F 1/1421; B65F 1/141; B65F 1/00; B65F 1/163

USPC ..... 220/262, 263, 908

See application file for complete search history.

(56) References Cited

U.S. PATENT DOCUMENTS

| | | | | |
|---|---|---|---|---|
| 1,176,046 | A * | 3/1916 | Foldeak | 220/263 |
| 1,450,713 | A | 4/1923 | Carey | |
| 2,811,329 | A | 10/1957 | Press et al. | |
| 4,200,197 | A * | 4/1980 | Meyer et al. | 220/263 |
| 6,345,725 | B1 * | 2/2002 | Lin | 220/263 |
| 6,626,316 | B2 | 9/2003 | Yang | |
| 6,981,606 | B2 | 1/2006 | Yang et al. | |
| 7,077,283 | B2 * | 7/2006 | Yang et al. | 220/262 |
| 7,285,928 | B1 | 10/2007 | Jolly et al. | |
| D564,170 | S | 3/2008 | Chen | |

(Continued)

FOREIGN PATENT DOCUMENTS

| | | | |
|---|---|---|---|
| DE | 202007002166 | U1 | 7/2008 |
| FR | 1152476 | A | 2/1958 |

*Primary Examiner* — Fenn Mathew
*Assistant Examiner* — Robert Stodola
(74) *Attorney, Agent, or Firm* — Dorsey & Whitney LLP

(57) ABSTRACT

A pedal type bin assembly (10) comprising a base (30) configured for accommodating a bin (12), a lid-bearing post (34) extending upright at a rear edge of the base and configured for supporting at a top end (36) thereof a pivotable lid (38), and a lifting mechanism (40). The lifting mechanism comprises a manipulating element (52) positioned at a front edge of the base and a leverage array (48, 50) articulated to the manipulating element, for manipulating the lid between an open and a closed position upon respective operation of the manipulating element.

14 Claims, 18 Drawing Sheets

(56) References Cited

U.S. PATENT DOCUMENTS

| | | | | |
|---|---|---|---|---|
| 7,484,635 | B2 | 2/2009 | Yang et al. | |
| 7,494,021 | B2 | 2/2009 | Yang et al. | |
| 7,530,578 | B2 * | 5/2009 | Niemeyer et al. | 280/47.26 |
| 7,543,716 | B2 * | 6/2009 | Lin | 220/495.11 |
| 7,748,556 | B2 | 7/2010 | Yang et al. | |
| 7,963,414 | B1 * | 6/2011 | Stravitz | 220/264 |
| 2004/0164077 | A1 * | 8/2004 | Kuo | 220/263 |
| 2005/0103788 | A1 | 5/2005 | Yang et al. | |
| 2006/0186121 | A1 | 8/2006 | Yang et al. | |
| 2007/0029323 | A1 * | 2/2007 | Yang et al. | 220/263 |
| 2008/0029513 | A1 * | 2/2008 | West | 220/262 |
| 2008/0237234 | A1 | 10/2008 | Yang et al. | |
| 2009/0071959 | A1 * | 3/2009 | Cheung | 220/263 |
| 2009/0084788 | A1 * | 4/2009 | Yang et al. | 220/263 |
| 2009/0236340 | A1 * | 9/2009 | Joordens | 220/263 |

* cited by examiner

PEDAL-BIN ASSEMBLY

CROSS-REFERENCE TO RELATED APPLICATIONS

This application is the National Stage of International Application No. PCT/IL2011/000160, filed Feb. 15, 2011, which claims the benefit of provisional U.S. Application No. 61/304,607, filed Feb. 15, 2010, the disclosures of which are incorporated herein by reference in their entirety.

FIELD OF THE INVENTION

This subject matter relates to bin systems and more particularly to a pedal operated bin system.

BACKGROUND OF THE INVENTION

A wide variety of pedal bin systems are known and typically comprise a housing formed with an enclosed receptacle accommodating a removable bin and coverable by a normally closed lid, wherein a pedal mechanism is provided for manipulating the lid into the open position.

SUMMARY OF THE INVENTION

In accordance with one aspect of the presently disclosed subject matter, there is provided a pedal type bin assembly comprising a base, a lid-bearing post extending upright at a rear edge of the base and configured for supporting at a top end thereof a pivotable lid, and a lifting mechanism comprising a manipulating element positioned at a front edge of the base and a leverage array articulated to said manipulating element, for manipulating the lid between an open and a closed position upon respective operation of the manipulating element.

Any one or more of the following features may be included in the pedal type bin assembly according to the presently disclosed subject matter:

- The lid-bearing post is a hollow L-shaped member having a horizontal portion and a vertical portion, configured for fixedly articulation to the base.
- The manipulating element is a pedal projecting at the front edge of the base.
- The leverage array further comprises a base lever formed at a front end thereof with said manipulating element and configured for pivotable engagement within the base.
- The base lever is received within the horizontal portion of the lid-bearing post.
- The leverage array further comprises a lifting lever pivotally coupled to said base lever.
- The lifting lever is received within the vertical portion of the lid-bearing post and freely slideable therein.
- The base further comprises a channel formed in a bottom surface thereof, for at least partially receiving therein a horizontal portion of the lid-bearing post, so that the lid-bearing post is maintained vertically upright and fixed with respect to the base, thereby firmly supporting the lid also during operation of the lifting mechanism.
- The lid-bearing post is integrally formed within the base.
- The base is an independent unit configured for seating a bin thereon.
- The base further comprises a rim upwardly protruding from a top surface thereof, allowing proper positioning of the bin over the base.
- the base is an integral part of the bin and constitutes a bottom base thereof.

- The bin assembly further comprises a damping mechanism configured for preventing free fall of the lid.
- The arrangement is such that at the closed position of the lid it extends over a top edge of a bin supported over the base. According to a particular design at said closed position the lid extends at a substantially horizontal position.

In accordance with another aspect of the presently disclosed subject matter there is provided bin kit comprising a bin and a pedal type bin assembly comprising:

a. a base; and
b. a lid-bearing post extending upright at a rear edge of the base and configured for supporting at a top end thereof a pivotable lid, and
c. a lifting mechanism comprising a manipulating element positioned at a front edge of the base and a leverage array articulated to said manipulating element, for manipulating the lid between an open and a closed position upon respective operation of the manipulating element.

The disclosed subject matter is directed to a pedal-type bin assembly comprising a base seating a bin, a lid-bearing post extending upright at a rear edge of the base and supporting at a top end thereof a pivotable lid, and a lifting mechanism comprising a pedal projecting at a front edge of the base and articulated to a leverage array for manipulating the lid between an open and a closed position upon respective operation of the pedal.

The bin assembly according to the presently disclosed subject matter is thus devoid of a bin receptacle, wherein the bin is exposed over the base and wherein the lid, at its closed position, bears directly upon a top edge of the bin.

The lifting mechanism is operable regardless if the bin is positioned over the base, wherein the lid may be displaced into its substantially upright, open position, also when the bin is removed.

The pedal-type bin assembly may be a DIY type, i.e. be shipped and distributed at a disassembled state, wherein erecting of the bin assembly requires substantially no hand tools, as all couplings of the respective elements are snap-type.

BRIEF DESCRIPTION OF THE DRAWINGS

In order to understand the presently disclosed subject matter and to see how it may be carried out in practice, embodiments will now be described, by way of non-limiting examples only, with reference to the accompanying drawings, in which.

DETAILED DESCRIPTION OF EMBODIMENTS

With reference to FIGS. 1A to 1E, there is illustrated a bin assembly according to an example of the presently disclosed subject matter, generally designated 10 and comprising a bin 12 and a bin carrier and lifting mechanism 14.

Figure 1A:
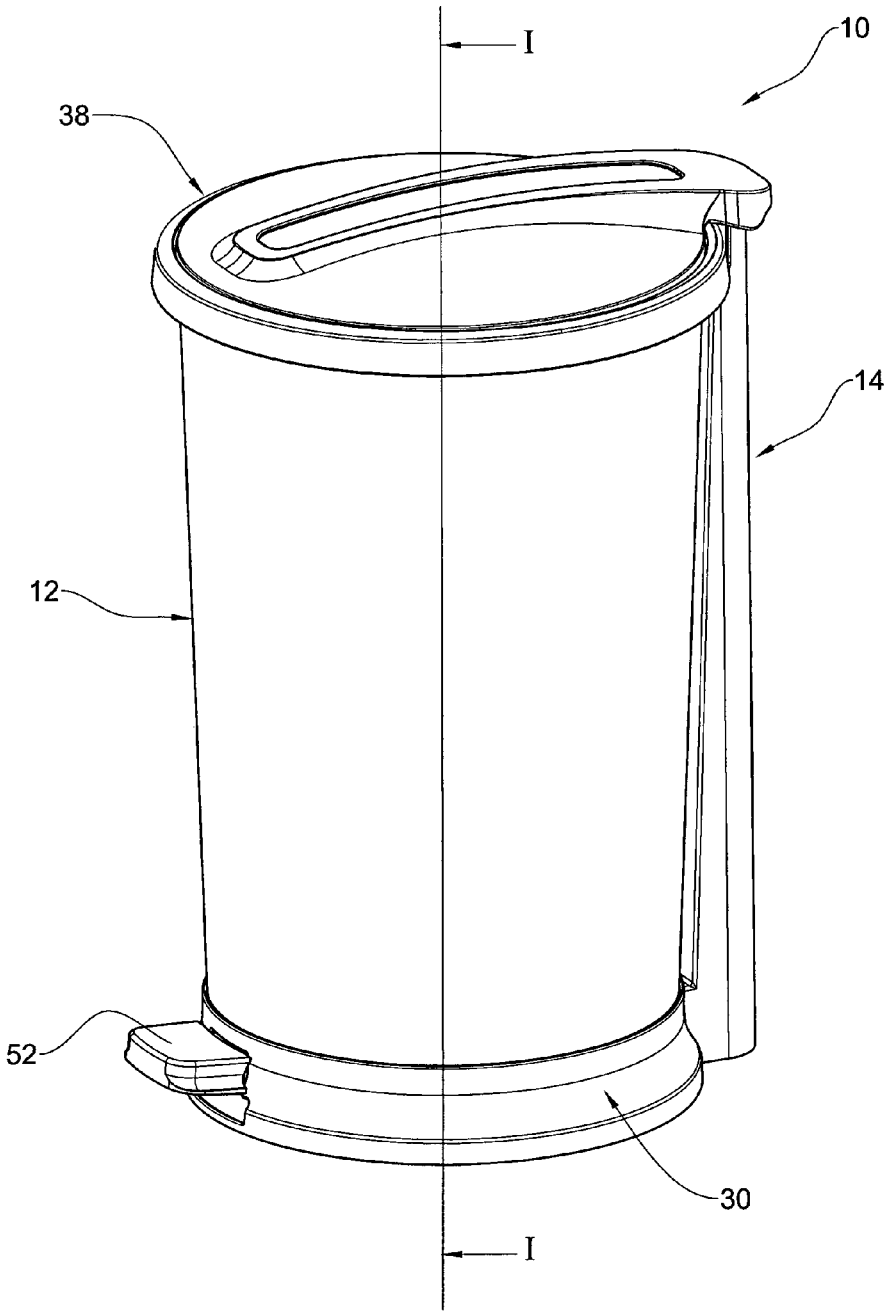
FIGS. 1A and 1B are a perspective and an exploded view, in the closed position, respectively, of one example of a pedal-bin system according to the subject matter of the present application.
Figure 1B:
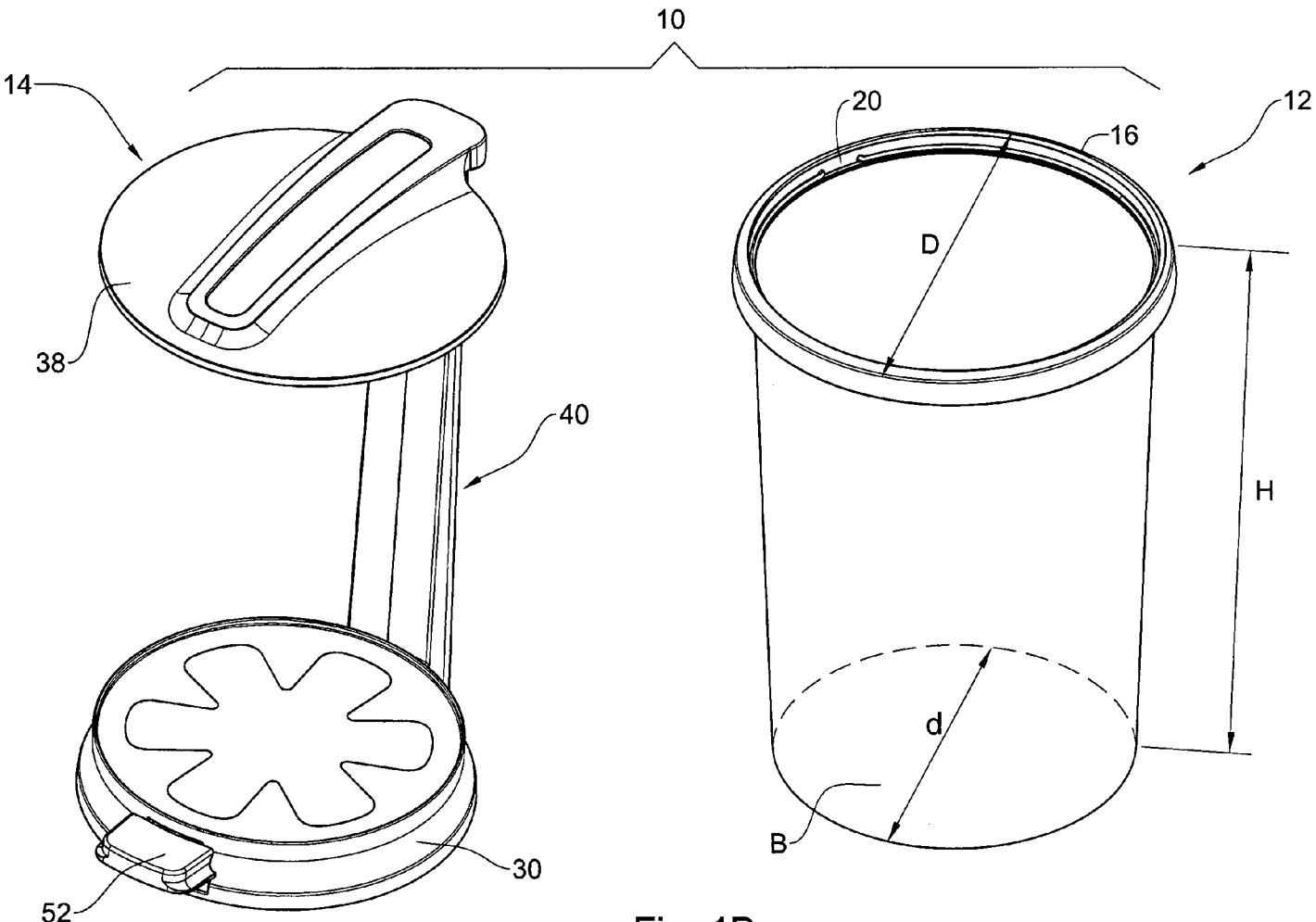

The bin 12, as best seen in FIG. 1B, is substantially cylindrical having a height H and a diameter D at its top open edge 16, and a bottom base B having a diameter d, and is fitted with a pivotable carrying handle 18 (FIG. 1C) which at its non-operable position rests within a peripheral groove 20. The handle 18, at its concealed position, may serve also for clamping a plastic bag received within the bin. However, at this position the handle does not project beyond the top edge 16.

The bin carrier and lifting mechanism 14 comprises a base 30 and a lid-bearing post 34 extending upright at a rear edge of the base 30 and supporting at a top end 36 thereof a pivotable lid 38.

With further reference being made also to FIGS. 2A to 6B it can be seen that the bin carrier 14 comprises a lifting mechanism generally designated 40 comprising in turn the lid-bearing post 34 which generally is a hollow L-shaped member, configured for fixedly articulation to the base 30. Lid 38 is pivotally secured to the top end 36 of the lid-bearing post 34 by a pair of lateral projections 42 snappingly received within bushings 44 integrally melded with the lid 38.

The lifting mechanism 40 further comprises a leverage array composed of a base lever 48 and a lifting lever 50, wherein the base lever 48 is formed at a front end thereof with a pedal 52 and is configured for pivotal engagement within the base by an integral hinge 54 snap fitted within a corresponding snap-type receptacle 56 formed adjacent a free end of the short leg 58 of the L-shaped lid-bearing post 34.

The base lever extends, at its rear end, within the short, horizontal leg 58 of the L-shaped lid-bearing post 34, and is pivotally coupled at its rear end 64 to a bottom end 66 of the a lifting lever 50, which in turn is received within the lid-bearing post 34 and is freely slideable there within. A top end 70 of the lid-bearing post 34 is configured with cam 72, bearing against arced cam followers 76 disposed at a rear end of the lid 38, as will become apparent herein after.

Figure 2A:
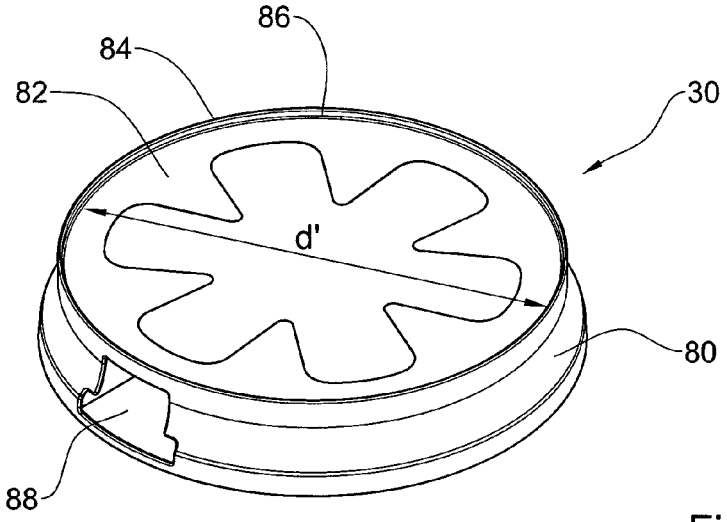
FIGS. 2A and 2B are perspective top and bottom views, respectively of a base constituting part of the pedal-bin system shown in FIGS. 1A and 1B.
Figure 2B:
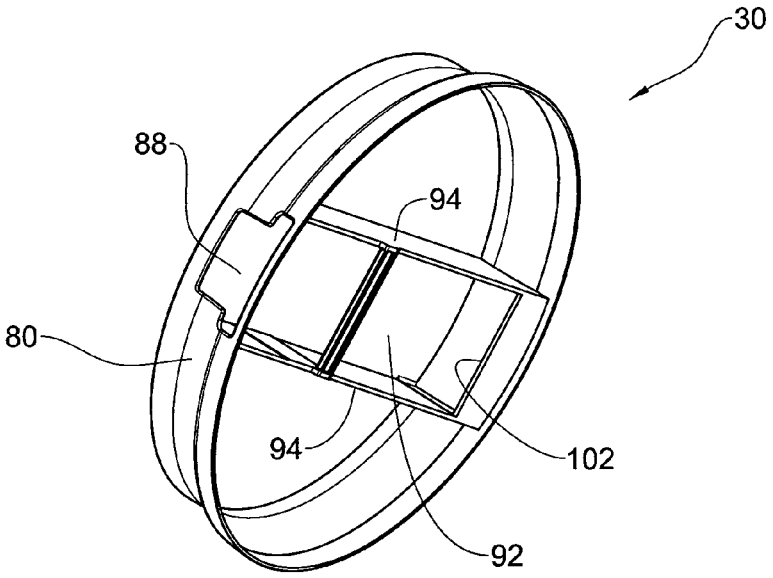

Base 30, shown in detail in FIG. 2B, is configured with a side wall 80, a top surface 82 and a rim 84 upwardly protruding from the top surface 82. The rim is configured with a peripheral chamfer, having an innermost diameter d' corresponding with or slightly greater than the diameter d of the base B of the bin 12. The chamfered rim provides that placing the bin 12 over the base entails proper positioning thereof at a centralized position over the base top surface 82 (with the lid 38 extending substantially coaxial above the base 30).

Base 30 is further formed, at its side wall 80 with a pedal opening 88 through which the base lever 48 projects, with the pedal 52 configured to substantially conceal the opening to gain an eye-pleasing effect.

A bottom side of the base is formed with a base lever channel 92, with two side walls 94, wherein the base lever 48 is received together with the short leg 58, the latter being fixedly supported with respect to the base 30 by a recessed portion 98 at a bottom face engaged over a corresponding arresting wall 102 of the base, thus preventing axial displacement of the short leg 58 and respectively the entire L-shaped lid-bearing post 34. This arrangement ensures that the lid-bearing post 34 is maintained vertically upright and fixed with respect to the base 30, thereby firmly supporting the lid 38, also during operation of the lid-lifting mechanism 40.

Figure 4A:
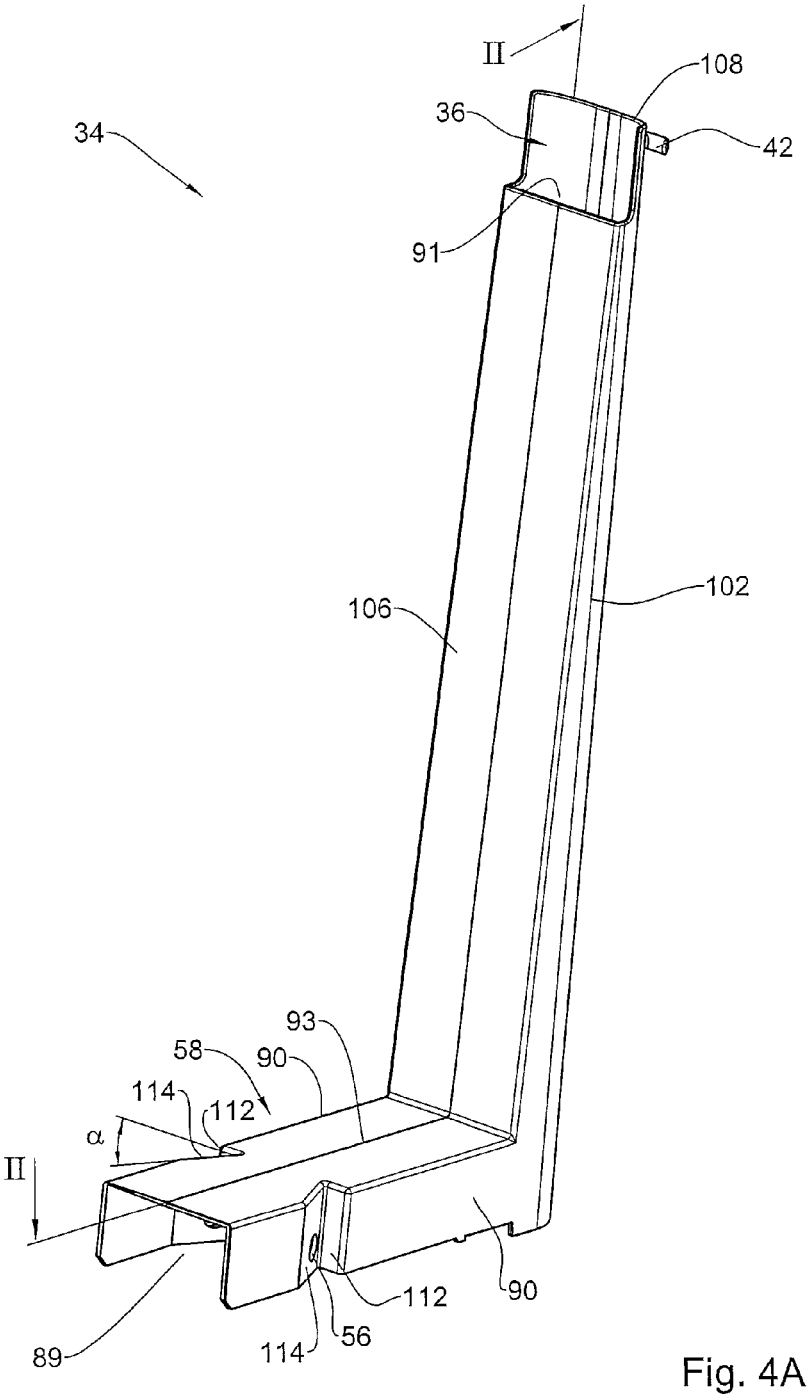
FIG. 4A is a perspective view of a lid-bearing post of the pedal-bin system.
Figure 4B:
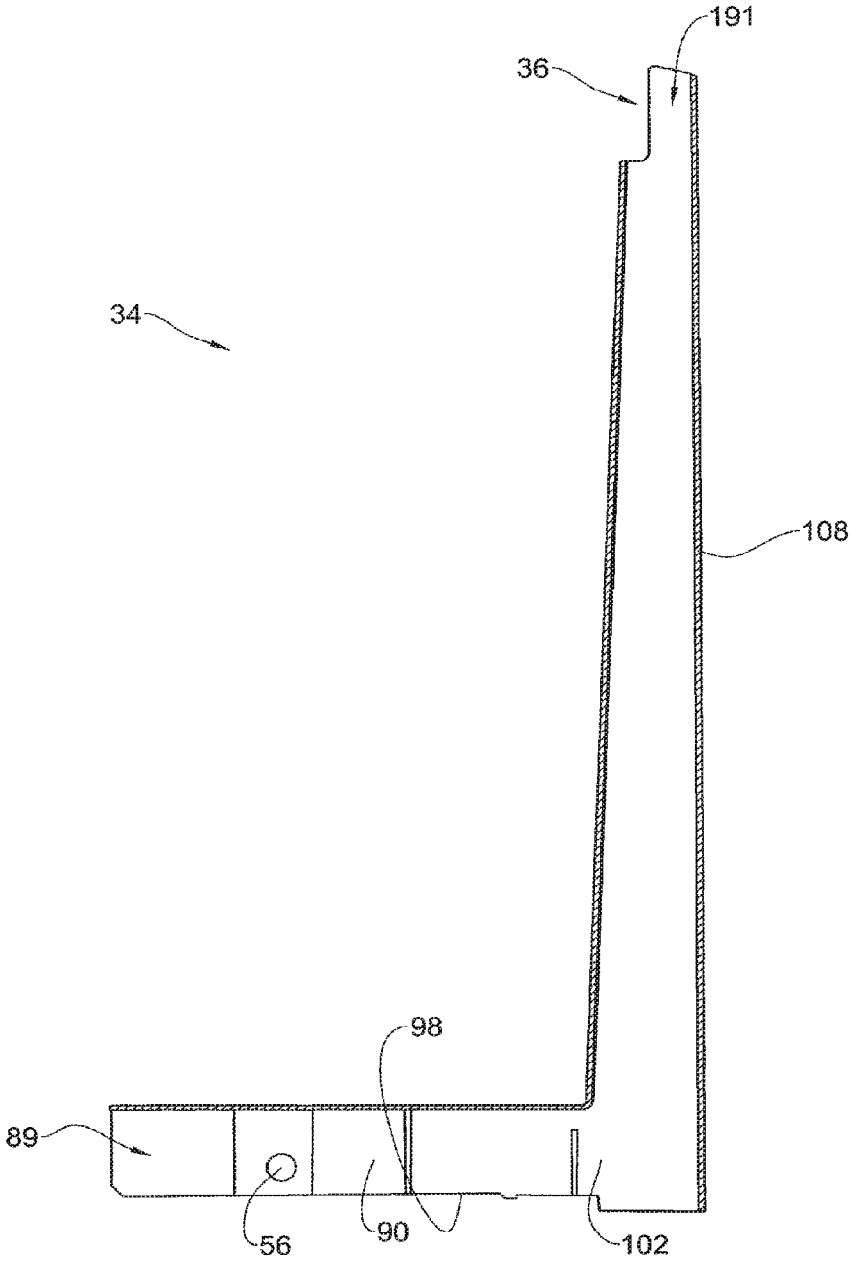
FIG. 4B is a cross-section of the lid-bearing post, along line II-II, in FIG. 4A.

As mentioned above, the L shaped lid-bearing post 34, shown in detail in FIGS. 4A and 4B, is hollow and consists of an open horizontal channel 89 formed by side walls 90 and a top surface 93 extending therebetween, and having an open bottom face; and a closed long, vertical channel 91 formed by side walls 102' and, front surface 106 extending therebetween and a slightly curved rear surface 108.

The lid-bearing post 34 further comprises wedge shaped indentations 112 on side walls surfaces 90, symmetrical and opposite each other and close to the open end of channel 89, the wedge surfaces 114 are formed with a sharp angle a and a pivot hole 56, for interacting with the pivot pin 54 of pedal 48, with an axis lateral to the side walls 90.

Figure 3A:
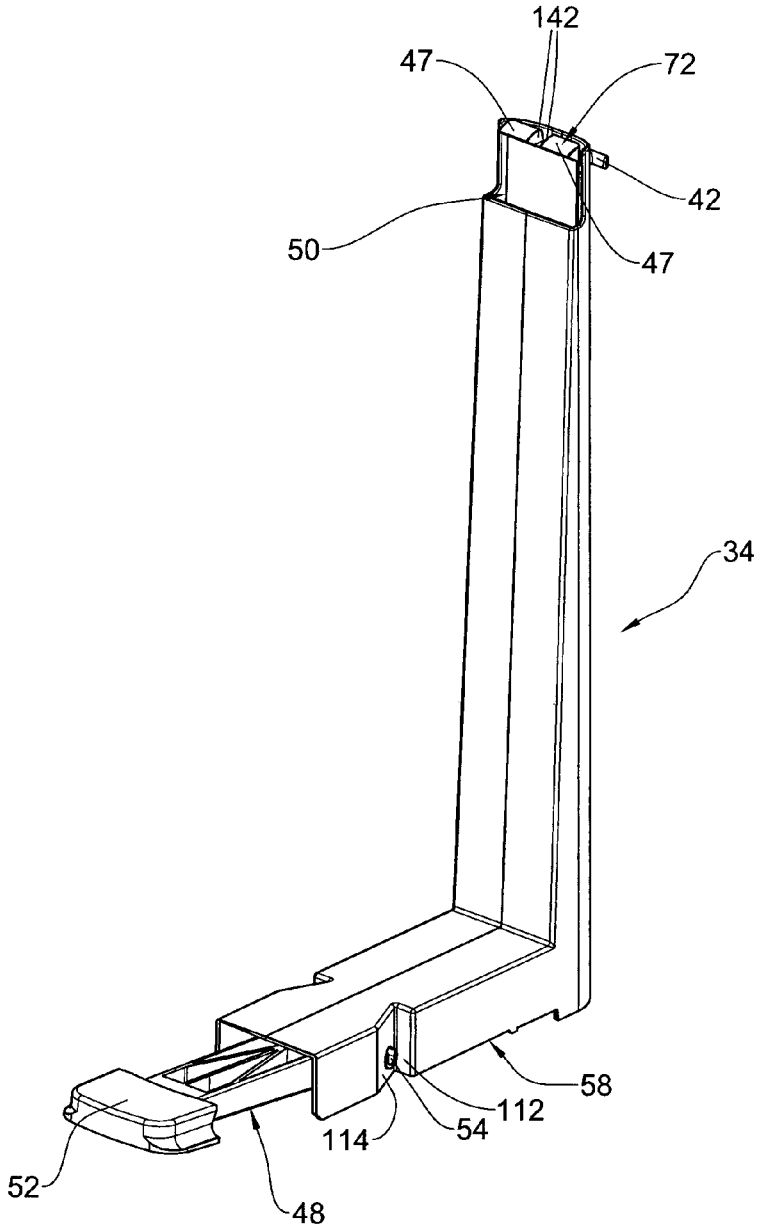
FIGS. 3A and 3B are perspective and exploded views, respectively, of a lifting mechanism assembly of the pedal-bin system.
Figure 3B:
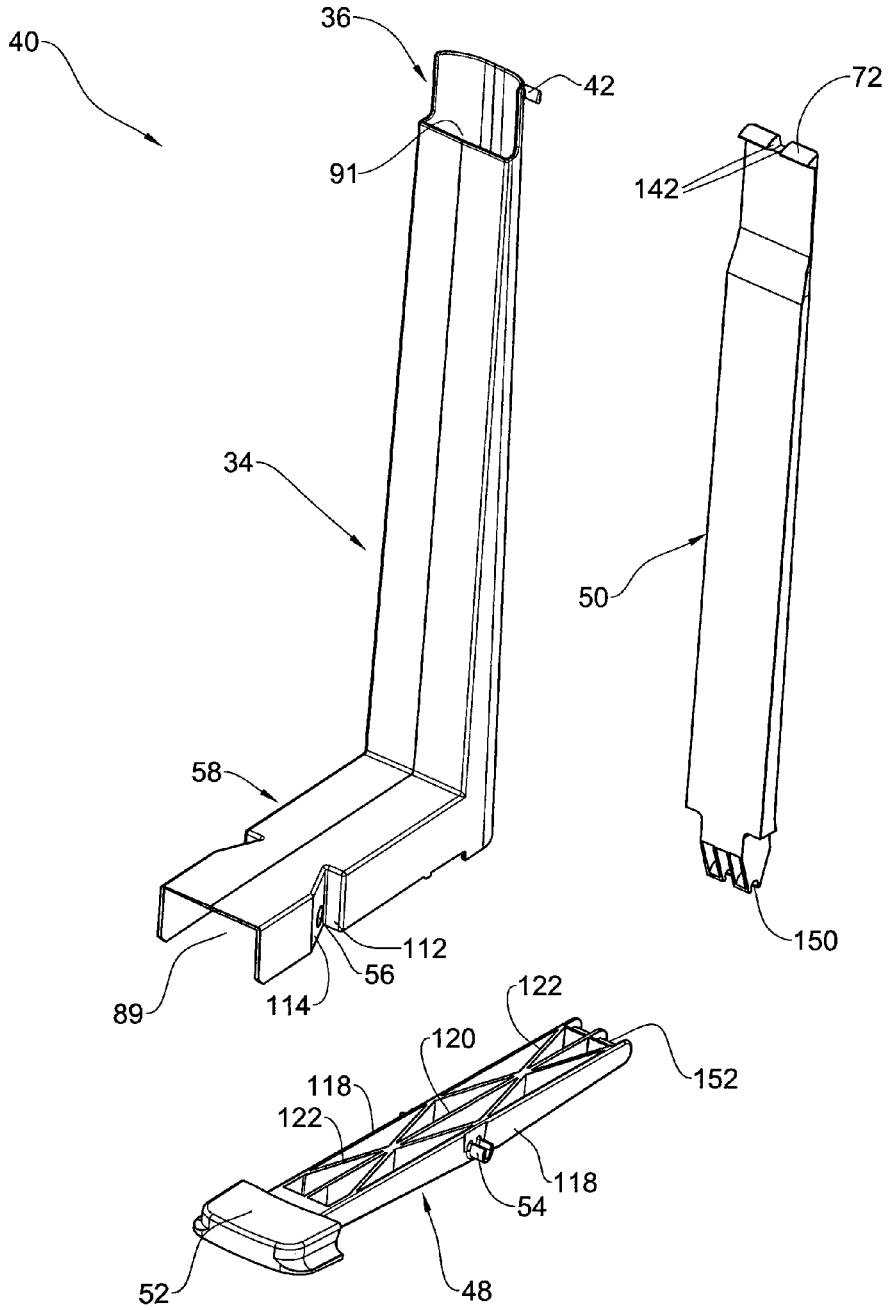
Figure 5:
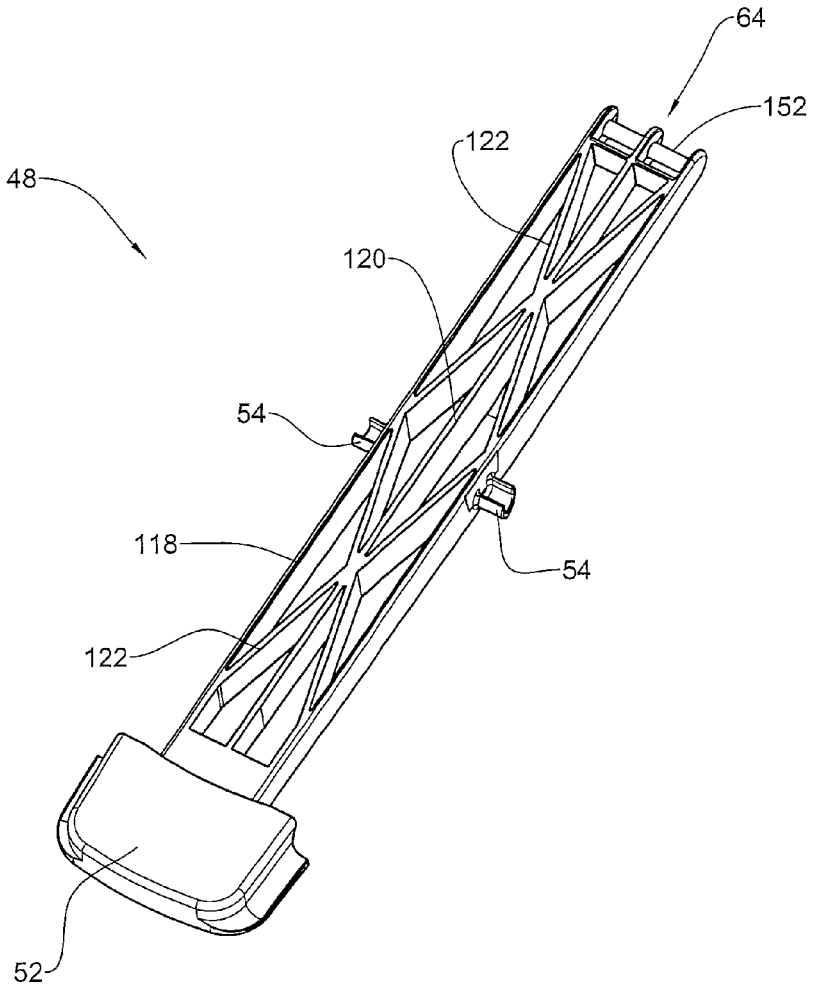
FIG. 5 is a perspective view of a pedal constituting part of the lifting mechanism assembly shown in FIGS. 3A and 3B.

Base lever 48 shown in FIGS. 3B and 5, has two parallel side surfaces 118 a central spine 120 connected to each other by cross-ribs 122 along most of their length. The base lever 48 further contains a foot press 52 at a fore end of thereof, and is configured to interact with lifting lever 50, at the opposite, rear end of the base lever 48.

Figure 6A:
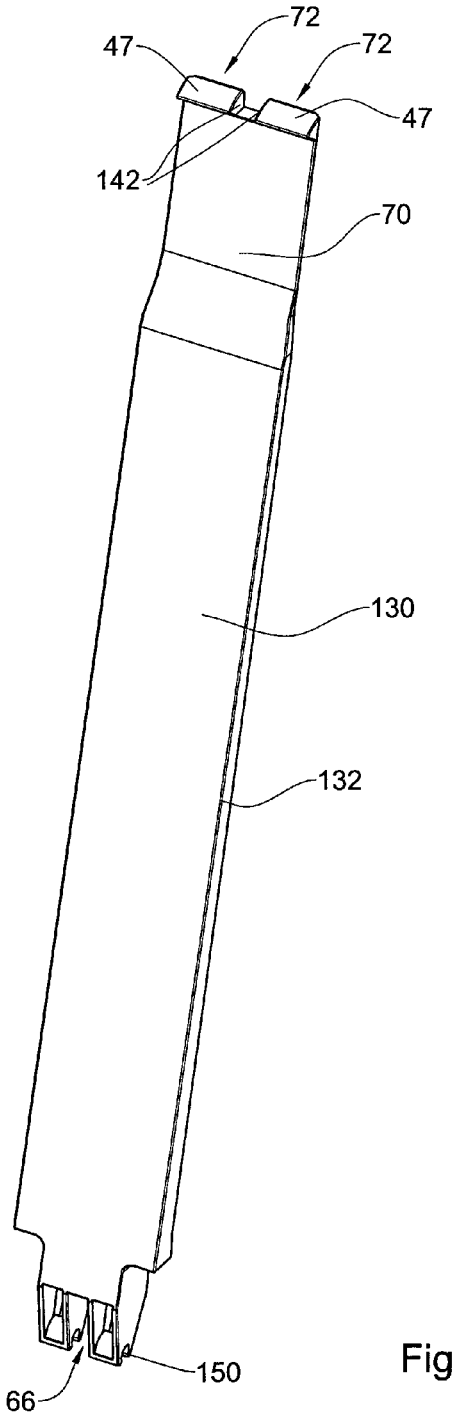
FIGS. 6A and 6B are perspective front and back views, respectively, of a lifting lever constituting part of the lifting mechanism assembly shown in FIGS. 3A and 3B.
Figure 6B:
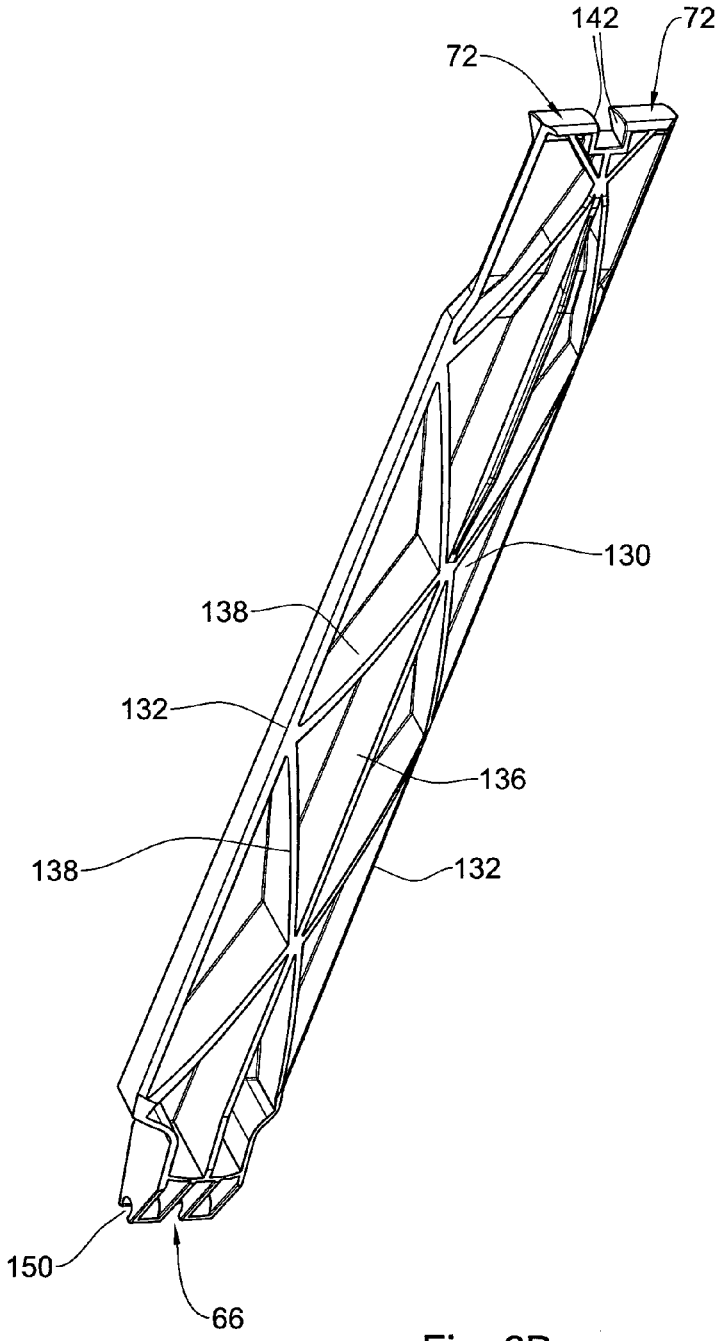

The lifting lever 50 shown in FIGS. 3B, 6A and 6B, has a major front wall 130, and side walls 132. To lend strength to the lifting lever 50 an arrangement of a central spine 136 and cross-ribs 138 are located between side walls. Located at the top 70 of the lifting lever 50 are two projections 142 formed with cams 72 having cam surfaces 47 and configured to interact with the matching cam follower surfaces 76 at a rear, bottom face of lid 38, facilitate the lifting action of the lid.

A bottom end of the lifting lever 50 is fitted with snap fingers 150, configured to interact with base lever 48 through its rear end circular snaps 152

Figure 7A:
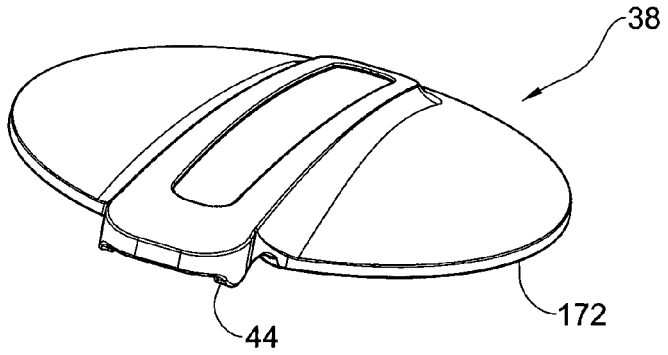
FIGS. 7A and 7B are perspective top and bottom views, respectively of a lid constituting part of the pedal-bin system shown in FIGS. 1A and 1B.
Figure 7B:
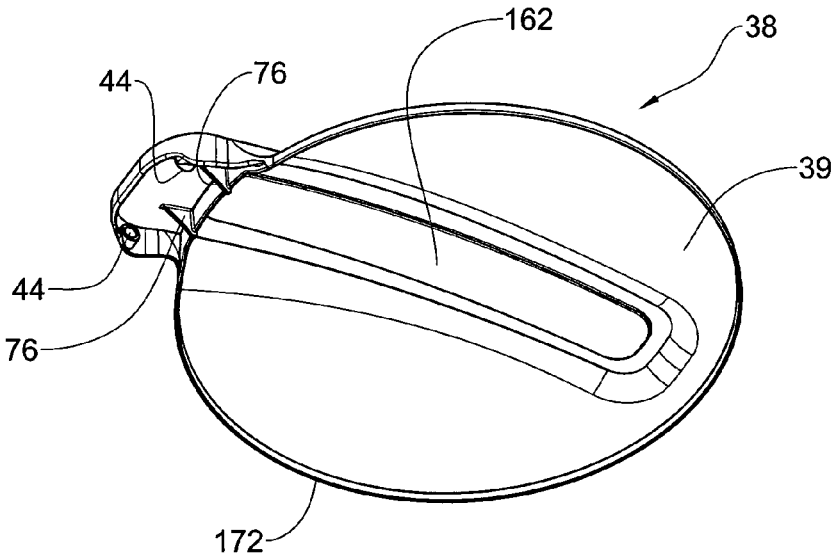

Referring now to the lid 38, shown in detail in FIGS. 7A and 7B, it is of circular shape having a diameter similar or slightly larger than diameter D of the top edge 16 of the open container 12, such that when at the closed position (FIG. 1A) it substantially covers the opening of the bin. A central channel 162 (FIG. 7B) extending along most of the diameter of the lid 38 contains the pivot bushings 44 configured to interact with pivots 42 of lid-bearing post 34, with cam follower surfaces 76 configured to interact with cams 72 at the top end 70 of the lifting lever 50.

Figure 8A:
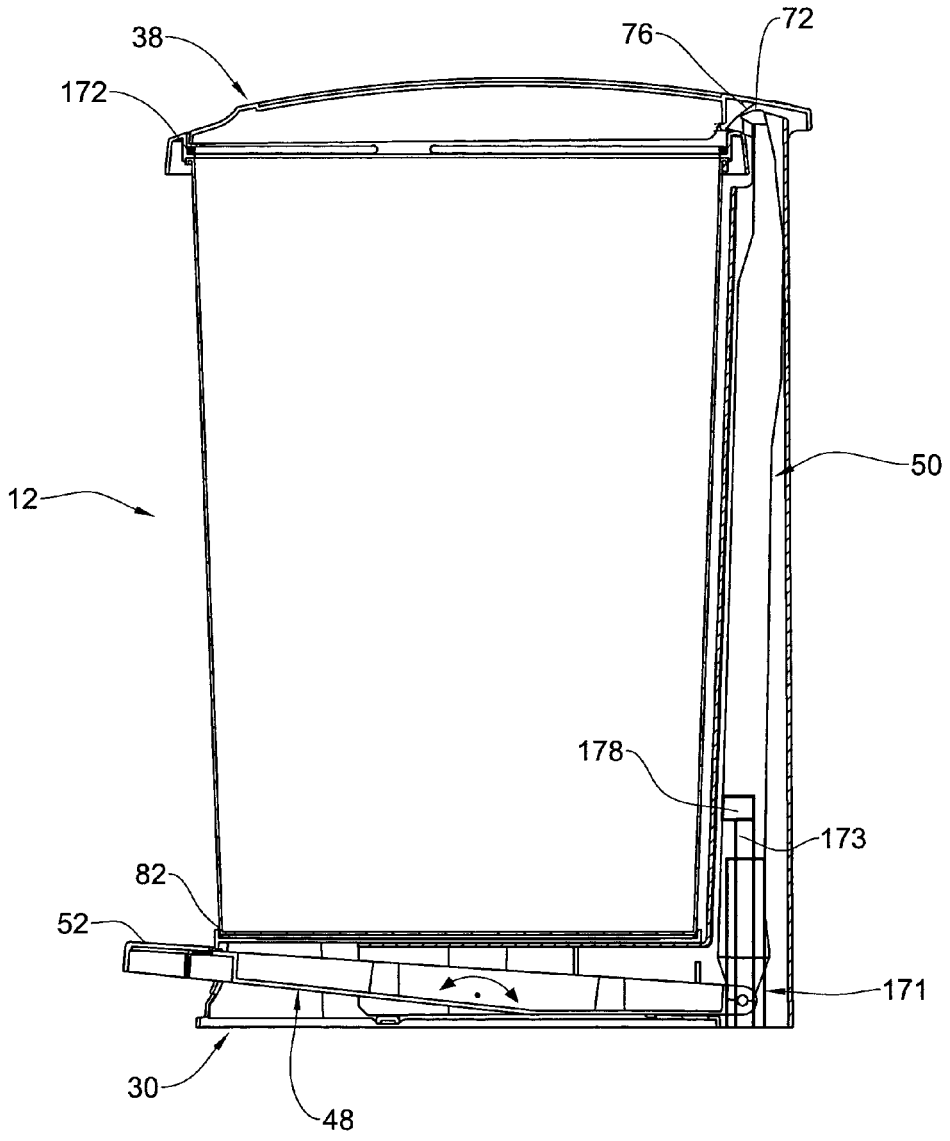
FIGS. 8A and 8B are cross-sections, according to line I-I of the pedal-bin system, in the closed and open positions respectively, shown in FIGS. 1A, 1B, 1C and 1D.
Figure 8B:
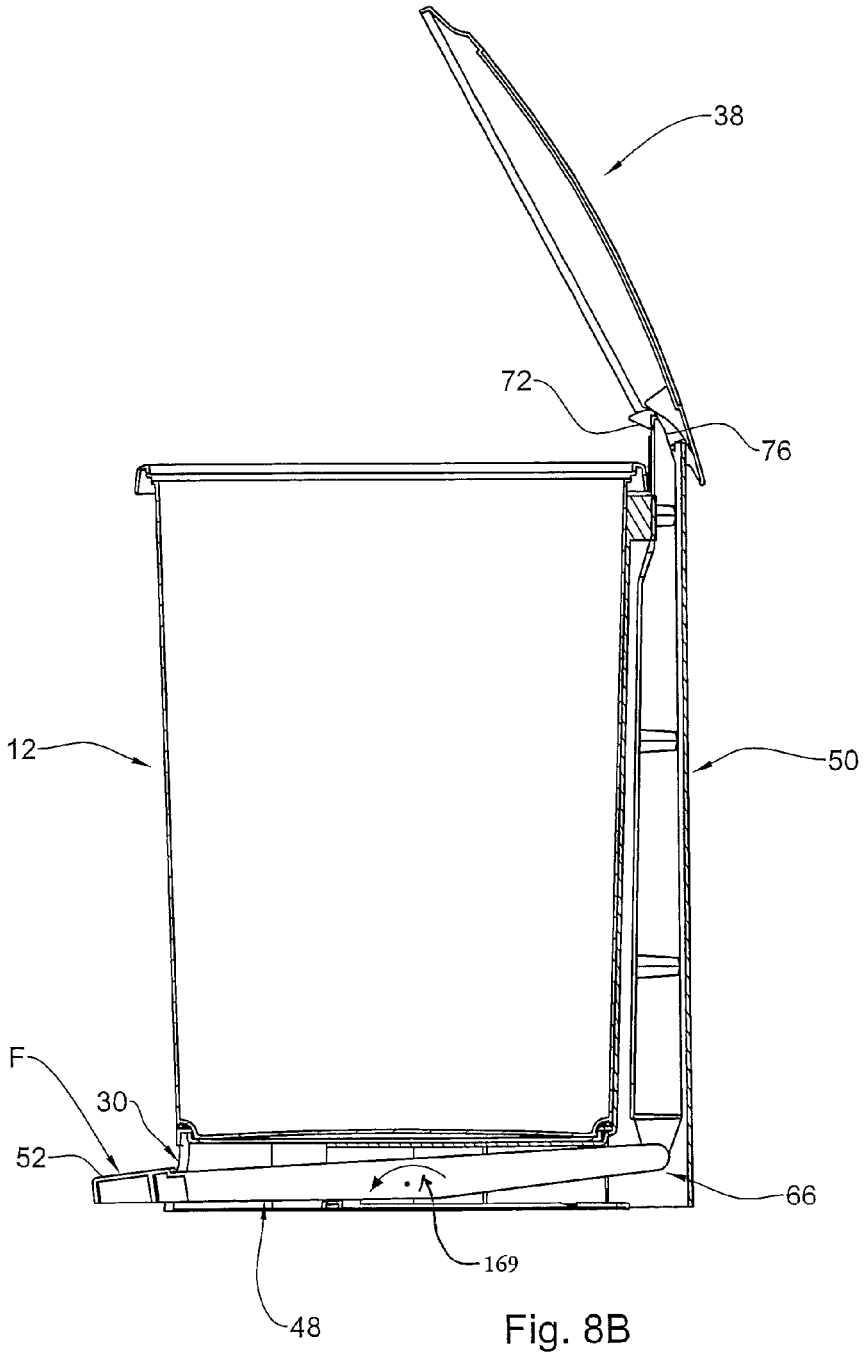

As shown in FIGS. 3A, 8A and 8B, in assembly, lifting lever 50 is inserted into the vertical channel 91 of the of the lid-bearing post 34, and the lifting lever 50 and lid-bearing post 34 subassembly is then inserted into channel 92 of the base 30 until the front surface 106 of the lid-bearing post 34 abuts side wall 80 of the base 30. The base lever 48 is inserted in to the open horizontal channel 89 of the lid-bearing post 34, via opening 88 of the base 30, allowing pivots 54 to slide along wedge surface 114 until the pivots snap into holes 56, and further allowing snap fingers 150 of the lid-bearing post 34 to couple with base lever 48 through its rear end circular snaps 152, thus completing the assembly of the lifting mechanism 40 to the base 30.

The lid 38 is attached to lid-bearing post 34 by snapping pivots 42 of the lid-bearing post 34 into bushings (pivot holes) 44 of the lid 38. In this state the distance between the peripheral edge 172 of the lid 38 to surface 82 of the base 30 substantially corresponds with the height H of the bin 12, thus allowing the placement of the open bin 12 over the top surface 82 of the base 30, and the lid 38 thus completing the assembly of the bin 10 in its normally closed position, where a bottom surface 39 of the lid 38 bears over the top edge 16 of the bin 12.

Figure 1C:
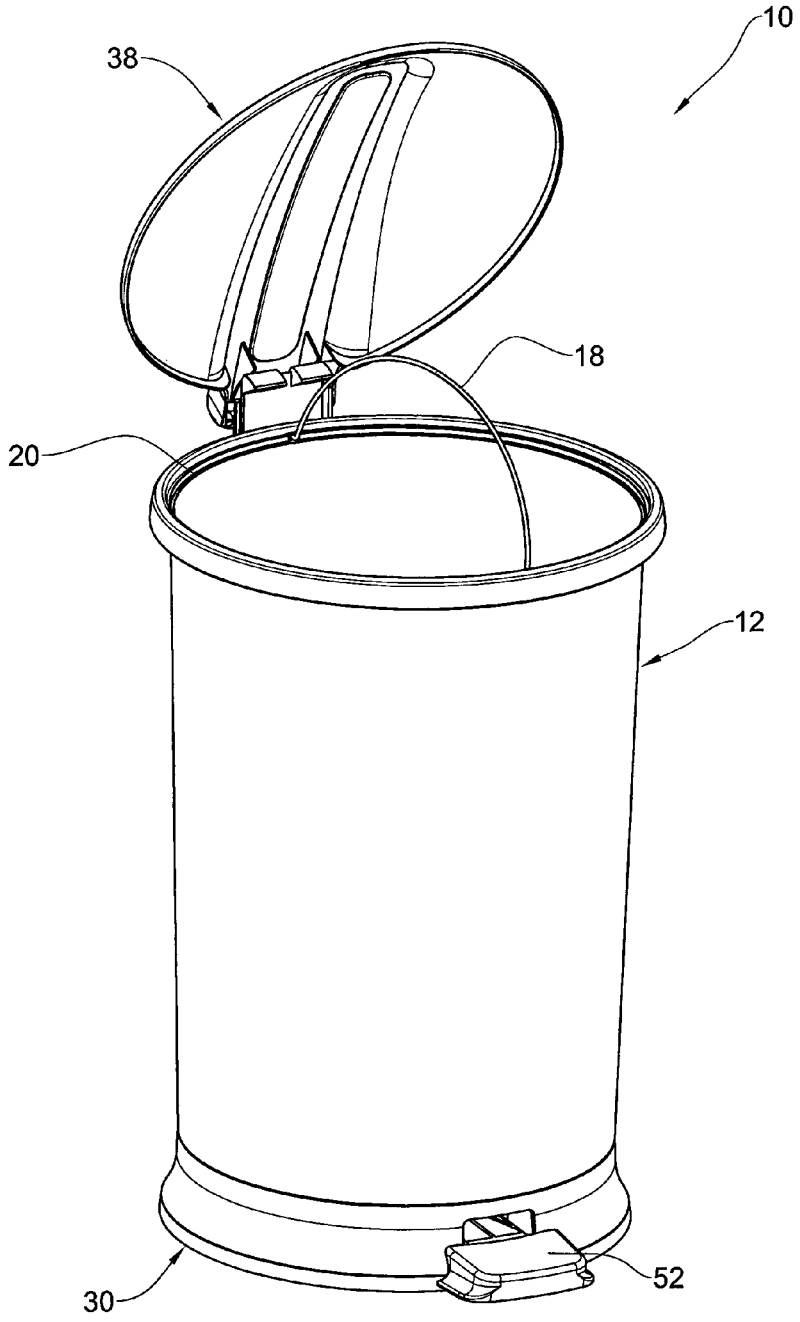
FIGS. 1C and 1D are perspective views of the pedal-bin system shown in Figs. 1A and 1B, in the open position.
Figure 1D:
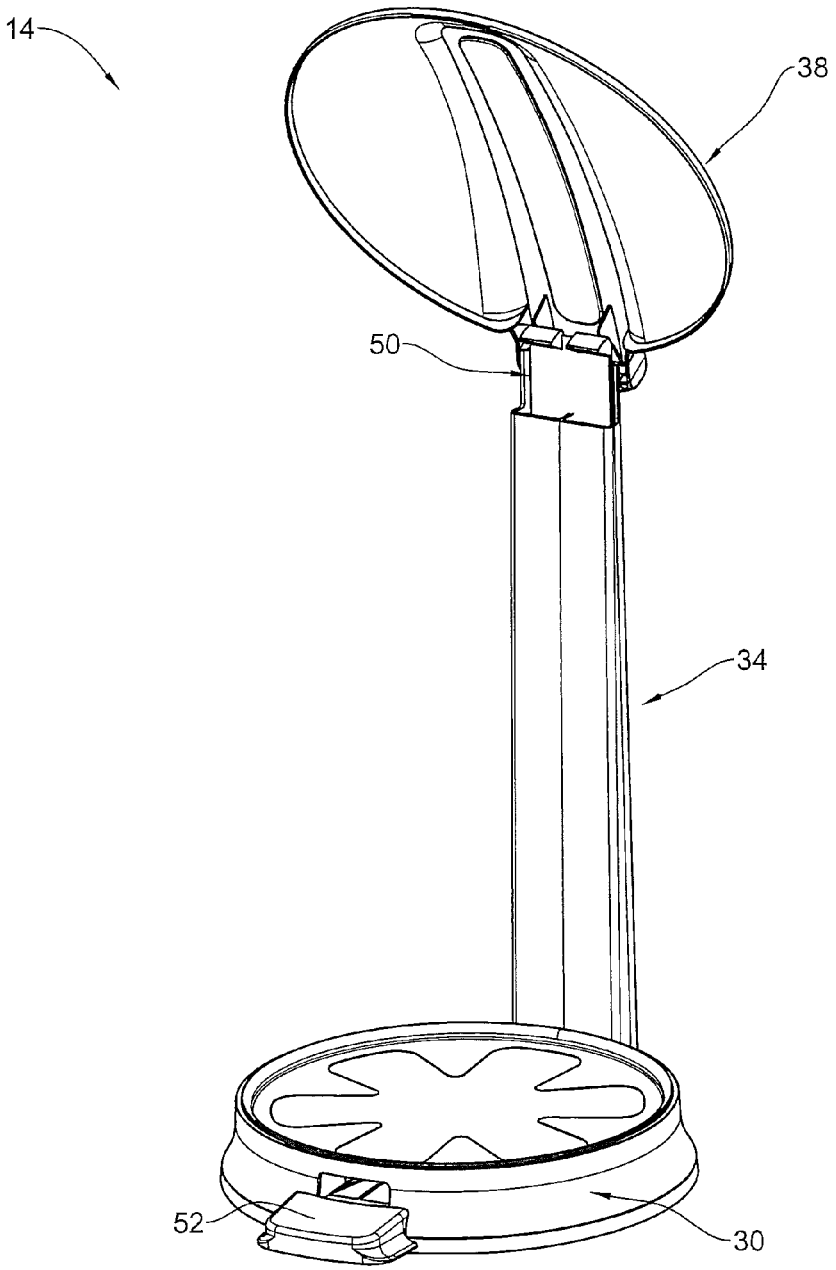
Figure 1E:
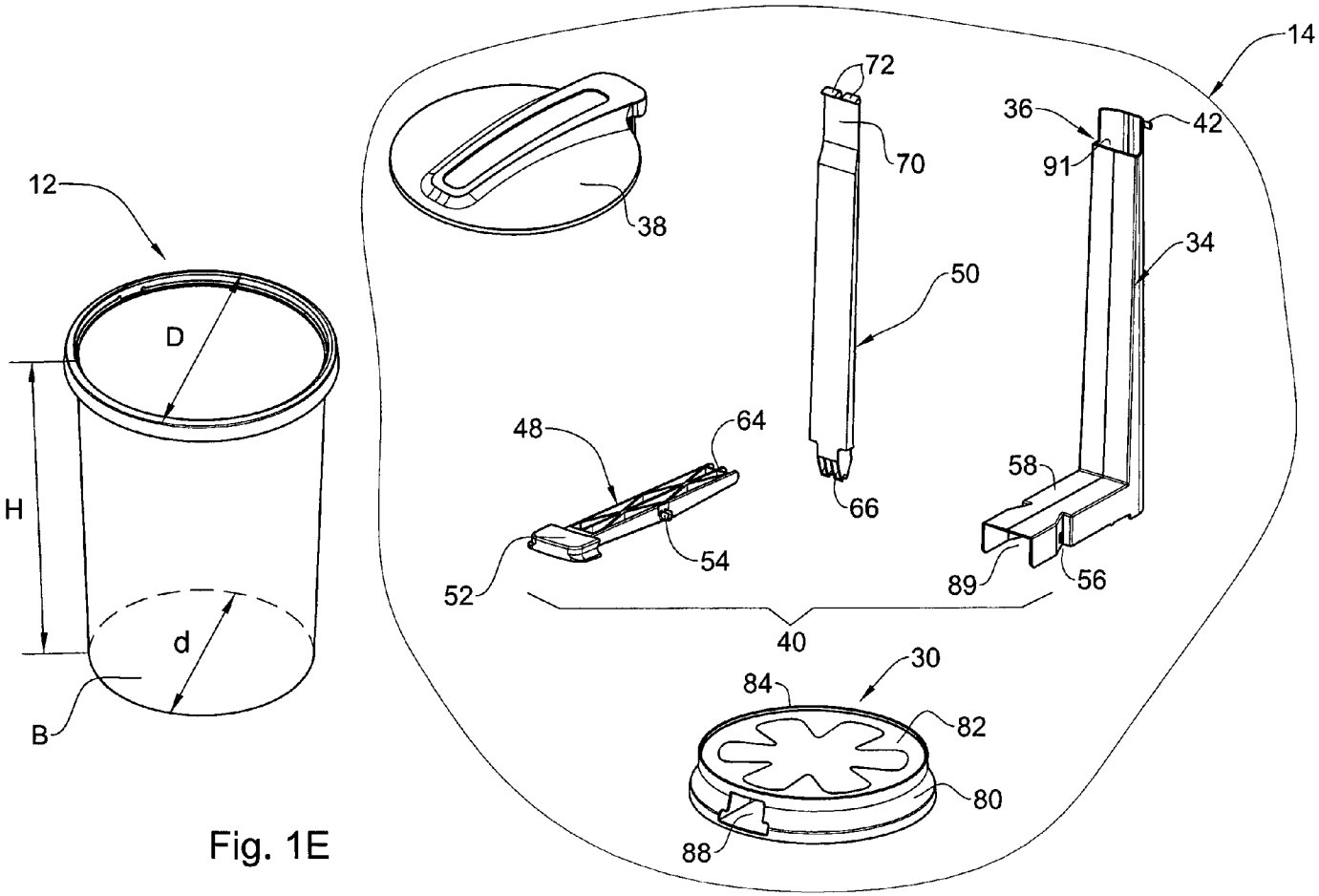
FIG. 1E is a further exploded view of the pedal-bin system shown in FIGS. 1A-1D.

In operation, as shown in FIG. 8B, a force F is applied to the base lever 48 at the foot press 52, causing the base lever 48 to pivot about pivot pins 54 in a counter clockwise direction as indicated by arrow 169, as the front end of the base lever 48 is pressed down the rear end attached to lid-bearing post 34 will rise, entailing corresponding upwardly directed displacement of the lifting lever 50. The cams 72 at the top end 70 of the lifting lever 50 engage cam surfaces 76 on the lid 38, whereby the relative motion of the cams cause the lid 38 to rotate around pivots 42 of the lid-bearing post 34 and thus lifting the lid to the open position of the bin assembly as illustrated in FIGS. 1C, 1D and 8B.

The cover 38 will remain in the open position for as long as the force F is applied to pedal 52. Once the force is released, the lid 38 will fall back, under its own weight, to the closed position.

In order to prevent the lid to free fall and cause noise and/or damage a damping mechanism 171 (FIG. 8A) is attached to the lifting mechanism, for slowing down the motion of the lid 38. In the example of FIG. 8A, the damping mechanism is a silicone buffer attached to the arresting wall 102 of the base 30 with a plunger 173 engaging a lateral projection 178 of the lifting lever 50. However, it is appreciated that other configurations are possible too.

Under normal operation, the lid will not remain at its open position, but will rather displace into its closed position under its self weight. However, according to a particular example, displacing the lid into its open position and further displacing it manually beyond about 90° will result in arresting of the lid at its open position. Closing the lid from this position is facilitated by pressing on the pedal to release the arresting edge or by manual displacing of the lid towards its closing position. This arrangement is useful for retaining the lid open while emptying the bin container. The arresting mechanism may be for example an arresting indent formed on one of the cam followers 76 and the cams 72, and a projection formed on another of the cam followers 76 and the cams 72 configured for engagement therewith.

In the illustrated example the L-shaped lid-bearing post 34 is separate from the base 30. However according to another example it may be integrated or integrally formed with the base. Likewise, the two arms of the lid-bearing post may be integral (as illustrated) or articulated upon assembly.

Whilst the bin 12 is a stand-alone article, it may be fitted with a liner (rigid or flexible and further it may be partitioned for purpose of separating the garbage into different sub compartments, thus conforming with environmental requirements.

Figure 9A:
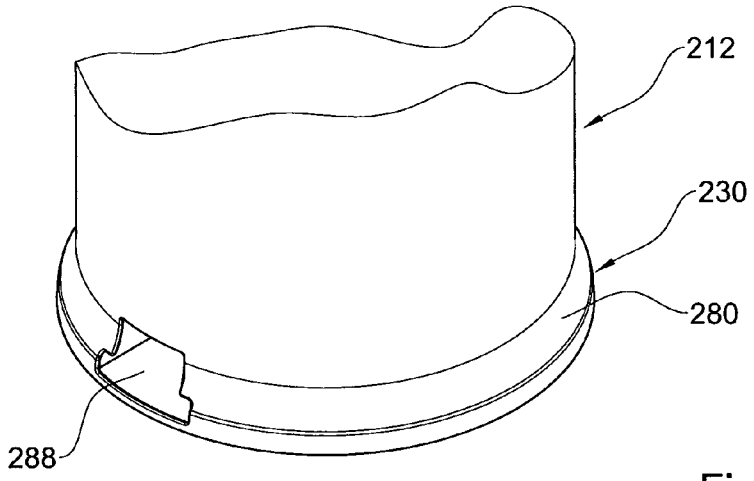
FIGS. 9A and 9B are perspective top and bottom views, respectively, of a base constituting an integral part of the bin according to of another example according to the subject matter of the present application.
Figure 9B:
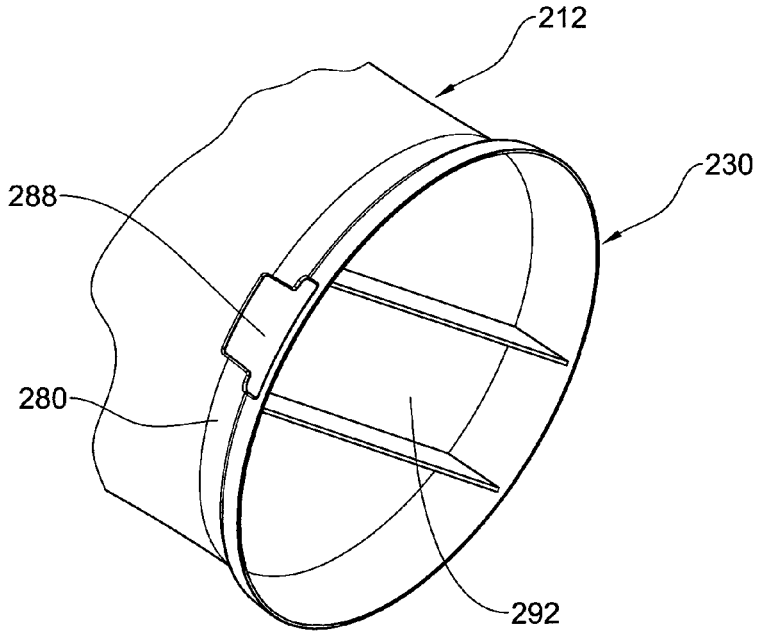

With reference to FIGS. 9A and 9B, a base according to the presently disclosed subject matter may constitute an integral part of the bin. In particular, the bin 212 (only partially shown) comprises a bottom base 230 formed with a pedal opening 288 at its side wall 280, constituting the side wall of the bin 212. The bottom base 230 further comprises a base lever channel 292, so that the short leg 58 of the lid bearing post 34 is received therein.

Figure 10:
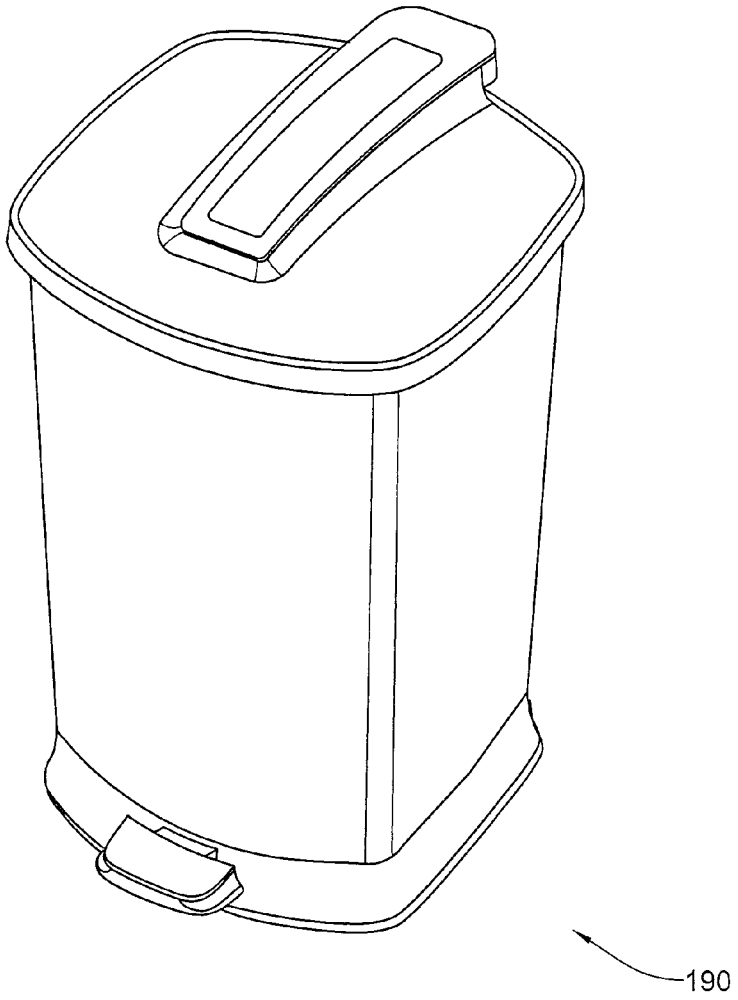
FIG. 10 is a perspective view of another example according to the subject matter of the present application.

FIG. 10 illustrates a bin assembly according to another example of the presently disclosed subject matter, generally designated 190, wherein the container bin and respective base and lid have a substantially rectangular cross-section, however with a like lid elevating mechanism.

All the parts of the bin assembly may be made of a thermoplastic polymer, such as polypropylene, except the handle, which is usually made of metal.

Those skilled in the art to which the presently disclosed subject matter pertains will readily appreciate that numerous changes, variations and modifications can be made without departing from the scope of the presently disclosed subject matter mutatis mutandis. For example, as noted in FIG. 10 the bin has a non-circular shape, with a corresponding shape imparted to the base and lid.

The invention claimed is:

1. A pedal type bin carrier assembly comprising:
- a base including a front portion and a rear portion having an arresting wall extending inwardly toward the front portion;
- a lid;
- a lid-bearing post extending upright at the rear edge of the base and configured for pivotally supporting at a top end thereof the lid;
- a lifting mechanism at least partially extending within the lid bearing post, comprising
  - a manipulating element positioned at the front edge of the base; and
  - a leverage array articulated to said manipulating element, for manipulating the lid between an open and a closed position upon respective operation of the manipulating element;

wherein, the lid-bearing post is a substantially hollow L-shaped member, configured for articulation to the base and being detachably attachable to the base, the L-shaped member including a generally horizontal portion and a generally vertical portion including a lowermost end, the generally horizontal portion including a bottom surface that partially defines a recessed portion, the bottom surface being vertically offset above the lowermost end of the generally vertical portion, the recessed portion and the arresting wall of the base configured to cooperate to limit axial displacement of the L-shaped member;

wherein the leverage array comprises:
- a base lever articulated to the manipulating element, the base lever being configured for a pivotal engagement with a horizontal portion of the L-shaped member; and
- a lifting lever, the lifting lever extending upright through the generally vertical portion of the L-shaped member being freely slideable therein and at its one end being pivotally coupled to the base Lever and at its other, top end, being configured with at least one cam surface configured to bear against at least one cam follower disposed at a rear end of the lid, to facilitate the lifting action of the lid; and wherein the assembly is adapted to removably receive and carry a bin over the base.

2. The bin assembly according to claim 1, wherein the manipulating element is a pedal projecting at the front edge of the base.

3. The bin assembly according to claim 1, wherein the leverage array further comprises the base lever formed at a front end thereof with said manipulating element and configured for pivotable engagement within the base.

4. The bin assembly according to claim 3, wherein said base lever is received within the generally horizontal portion of the lid-bearing post.

5. The bin assembly according to claim 1, wherein the base further comprises a channel formed in a bottom surface thereof, for at least partially receiving therein the generally horizontal portion of the lid-bearing post, so that the lid-bearing post is maintained vertically upright and fixed with respect to the base, thereby firmly supporting the lid also during operation of the lifting mechanism.

6. The bin assembly according to claim 1, wherein the lid-bearing post is integrally formed within the base.

7. The bin assembly according to claim 1, wherein the base is an independent unit configured for accommodating a bin thereon.

8. A bin kit comprising a bin and a pedal type bin carrier assembly comprising:

a base including a front portion and a rear portion having an arresting wall extending inwardly toward the front portion;

a lid;

a lid-bearing post extending upright at the rear edge of the base and configured for pivotally supporting at a top end thereof the lid; and a lifting mechanism at least partially extending within the lid bearing post, comprising:

a manipulating element positioned at the front edge of the base; and a leverage array articulated to said manipulating element, for manipulating the lid between an open and a closed position upon respective operation of the manipulating element;

wherein, the lid-bearing post is a substantially hollow L-shaped member, configured for articulation to the base and being detachably attachable to the base, the L-shaped member including a generally horizontal portion and a generally vertical portion including a lowermost end, the generally horizontal portion including a bottom surface that partially defines a recessed portion, the bottom surface being vertically offset above the lowermost end of the generally vertical portion, the recessed portion and the arresting wall of the base configured to cooperate to limit axial displacement of the L-shaped member;

wherein the leverage array comprises:

a base lever articulated to the manipulating element, the base lever being configured for a pivotal engagement with a short leg of the L-shaped member;

a lifting lever, the lifting lever extending upright through a long leg of the L-shaped member and at its one end being pivotally coupled to the base lever and at its other, top end, being configured with at least one cam surface configured to bear against at least one cam follower disposed at a rear end of the lid, to facilitate the lifting action of the lid; and wherein the assembly is adapted to removably receive and carry a bin over the base.

9. The kit according to claim 8, wherein the manipulating element is a pedal projecting at the front edge of the base.

10. The kit according to claim 8, wherein the leverage array further comprises a base lever formed at a front end thereof with said manipulating element and configured for pivotable engagement within the base.

11. The kit according to claim 10 wherein said base lever is received within the generally horizontal portion of the lid-bearing post.

12. The kit according to claim 8, wherein the base further comprises a channel formed in a bottom surface thereof, for at least partially receiving therein the generally horizontal portion of the lid-bearing post, so that the lid-bearing post is maintained vertically upright and fixed with respect to the base, thereby firmly supporting the lid also during operation of the lifting mechanism.

13. The kit according to claim 8, wherein the lid-bearing post is integrally formed within the base.

14. The kit according to claim 8, wherein the base is an independent unit configured for accommodating the bin thereon.

* * * * *